US009559433B2

(12) United States Patent
Zhou et al.

(10) Patent No.: US 9,559,433 B2
(45) Date of Patent: Jan. 31, 2017

(54) ANTENNA SYSTEM HAVING TWO ANTENNAS AND THREE PORTS

(71) Applicant: Apple Inc., Cupertino, CA (US)

(72) Inventors: Yijun Zhou, Sunnyvale, CA (US); Nanbo Jin, Sunnyvale, CA (US); Yuehui Ouyang, Sunnyvale, CA (US); Enrique Ayala Vazquez, Watsonville, CA (US); Anand Lakshmanan, San Jose, CA (US); Robert W. Schlub, Cupertino, CA (US); Mattia Pascolini, Campbell, CA (US); Matthew A. Mow, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 464 days.

(21) Appl. No.: 13/846,481

(22) Filed: Mar. 18, 2013

(65) Prior Publication Data

US 2014/0266923 A1 Sep. 18, 2014

(51) Int. Cl.
*H01Q 21/28* (2006.01)
*H01Q 1/24* (2006.01)
(Continued)

(52) U.S. Cl.
CPC ..... *H01Q 21/28* (2013.01); *H01Q 1/24* (2013.01); *H01Q 1/243* (2013.01); *H01Q 5/35* (2015.01); *H01Q 9/0421* (2013.01); *H01Q 9/06* (2013.01)

(58) Field of Classification Search
CPC ..... H01Q 11/28; H01Q 5/35
(Continued)

(56) References Cited

U.S. PATENT DOCUMENTS 4,518,965 A 5/1985 Hidaka
5,048,118 A 9/1991 Brooks et al.
(Continued)

FOREIGN PATENT DOCUMENTS

CN 102110873 6/2011
CN 102683861 9/2012
(Continued)

OTHER PUBLICATIONS

Darnell et al., U.S. Appl. No. 13/368,855, filed Feb. 8, 2012.
Jin et al., U.S. Appl. No. 13/846,471, filed Mar. 18, 2013.
Ouyang et al., U.S. Appl. No. 13/846,459, filed Mar. 18, 2013.

*Primary Examiner* — Dameon E Levi
*Assistant Examiner* — Walter Davis
(74) *Attorney, Agent, or Firm* — Treyz Law Group, P.C.; G. Victor Treyz; Michael H. Lyons

(57) ABSTRACT

Electronic devices may include radio-frequency transceiver circuitry and antenna structures. The antenna structures may form a dual arm inverted-F antenna and a monopole antenna sharing a common antenna ground. The antenna structures may have three ports. A first antenna port may be coupled to an inverted-F antenna resonating element at a first location and a second antenna port may be coupled to the inverted-F antenna resonating element at a second location. A third antenna port may be coupled to the monopole antenna. Tunable circuitry can be used to tune the antenna structures. An adjustable capacitor may be coupled to the first port to tune the inverted-F antenna. An additional adjustable capacitor may be coupled to the third port to tune the monopole antenna. Transceiver circuitry for supporting wireless local area network communications, satellite navigation system communications, and cellular communications may be coupled to the first, second, and third antenna ports.

22 Claims, 6 Drawing Sheets

(51) Int. Cl.
*H01Q 9/06* (2006.01)
*H01Q 9/04* (2006.01)
*H01Q 5/35* (2015.01)

(58) Field of Classification Search
USPC ..... 343/702, 700 MS
See application file for complete search history.

(56) References Cited

U.S. PATENT DOCUMENTS 5,768,691 A 6/1998 Kangas et al.
5,832,372 A 11/1998 Clelland et al.
6,034,636 A 3/2000 Saitoh
6,218,997 B1 4/2001 Lindenmeier et al.
6,317,094 B1 11/2001 Wu et al.
6,414,641 B1 7/2002 Carlson et al.
6,423,915 B1 7/2002 Winter
6,498,586 B2 12/2002 Pankinaho
6,504,507 B2 1/2003 Geeraert
6,560,443 B1 5/2003 Vaisanen et al.
6,650,295 B2 11/2003 Ollikainen et al.
6,670,923 B1 12/2003 Kadambi et al.
6,714,162 B1 3/2004 Kadambi et al.
6,734,825 B1 5/2004 Guo et al.
6,762,723 B2 7/2004 Nallo et al.
6,762,729 B2 7/2004 Egashira
6,836,249 B2 12/2004 Kenoun et al.
6,917,335 B2 7/2005 Kadambi et al.
6,933,893 B2 8/2005 Rubinshteyn et al.
6,950,065 B2 9/2005 Ying et al.
6,970,137 B1 11/2005 Maslovski et al.
6,980,154 B2 12/2005 Vance et al.
7,043,285 B2 5/2006 Boyle
7,075,493 B2 7/2006 Azadegan et al.
7,079,079 B2 7/2006 Jo et al.
7,145,513 B1 12/2006 Cohen
7,164,387 B2 1/2007 Sievenpiper
7,183,982 B2 2/2007 Kadambi et al.
7,215,283 B2 5/2007 Boyle
7,250,910 B2 7/2007 Yoshikawa et al.
7,260,424 B2 8/2007 Schmidt
7,408,515 B2 8/2008 Leisten
7,439,911 B2 10/2008 Wang
7,551,142 B1 * 6/2009 Zhang et al. ..... 343/702
7,595,759 B2 9/2009 Schlub et al.
7,612,725 B2 11/2009 Hill et al.
7,626,551 B2 12/2009 Chien et al.
7,671,804 B2 * 3/2010 Zhang ..... H01Q 1/243 343/700 MS
7,768,462 B2 8/2010 Zhang et al.
7,808,438 B2 10/2010 Schlub et al.
7,812,774 B2 10/2010 Friman et al.
7,834,813 B2 * 11/2010 Caimi ..... H01Q 9/045 343/745
7,843,396 B2 11/2010 Hill et al.
7,889,143 B2 2/2011 Milosavljevic et al.
7,893,883 B2 2/2011 Schlub et al.
7,898,485 B2 3/2011 Schlub et al.
7,924,226 B2 4/2011 Soler Castany et al.
7,924,231 B2 4/2011 Hill et al.
8,063,827 B2 11/2011 Hotta et al.
8,094,079 B2 1/2012 Schlub et al.
8,111,640 B2 2/2012 Knox
8,270,914 B2 9/2012 Pascolini et al.
8,350,761 B2 1/2013 Hill et al.
8,599,089 B2 12/2013 Bevelacqua et al.
8,610,629 B2 12/2013 Pascolini et al.
8,773,310 B2 7/2014 Shiu et al.
2003/0098812 A1 5/2003 Ying et al.
2003/0122721 A1 7/2003 Sievenpiper
2003/0222823 A1 12/2003 Flint et al.
2004/0140933 A1 7/2004 Shikata et al.
2004/0222926 A1 11/2004 Kontogeorgakis et al.
2004/0227674 A1 11/2004 Asano et al.
2004/0227678 A1 11/2004 Sievenpiper
2004/0257283 A1 12/2004 Asano et al.
2005/0007291 A1 1/2005 Fabrega-Sanchez et al.
2005/0151689 A1 7/2005 Vesterinen
2005/0270242 A1 12/2005 Qi et al.
2005/0280587 A1 12/2005 Svigelj et al.
2006/0055606 A1 3/2006 Boyle
2006/0097918 A1 5/2006 Oshiyama
2006/0178116 A1 8/2006 Qi et al.
2007/0008222 A1 1/2007 Wang et al.
2007/0222697 A1 9/2007 Caimi et al.
2008/0055164 A1 3/2008 Zhang et al.
2008/0150815 A1 6/2008 Nakahata et al.
2008/0165065 A1 7/2008 Hill et al.
2008/0218291 A1 9/2008 Zhu
2008/0238794 A1 10/2008 Pan et al.
2008/0253345 A1 * 10/2008 Sanguinetti ..... H01Q 1/2291 370/339
2008/0278379 A1 11/2008 Wang et al.
2008/0316115 A1 12/2008 Hill et al.
2009/0051604 A1 2/2009 Zhang et al.
2009/0051611 A1 2/2009 Shamblin et al.
2009/0128428 A1 5/2009 Ishizuka et al.
2009/0180403 A1 7/2009 Tudosoiu
2009/0231215 A1 9/2009 Taura
2009/0322639 A1 12/2009 Lai
2010/0053002 A1 3/2010 Wojack et al.
2010/0085260 A1 4/2010 McKinzie et al.
2010/0231470 A1 9/2010 Lee et al.
2010/0238079 A1 9/2010 Ayatollahi et al.
2010/0253538 A1 10/2010 Smith
2010/0279734 A1 11/2010 Karkinen et al.
2010/0295737 A1 11/2010 Milosavljevic et al.
2011/0021139 A1 1/2011 Montgomery et al.
2011/0102290 A1 5/2011 Milosavljevic
2011/0133995 A1 6/2011 Pascolini et al.
2011/0183721 A1 7/2011 Hill et al.
2011/0188552 A1 8/2011 Yoon et al.
2011/0193754 A1 8/2011 Schlub et al.
2011/0241949 A1 10/2011 Nickel et al.
2011/0250928 A1 10/2011 Schlub et al.
2011/0312393 A1 12/2011 Pulimi et al.
2011/0316751 A1 12/2011 Jarvis et al.
2012/0009983 A1 1/2012 Mow et al.
2012/0046002 A1 2/2012 Hill
2012/0112969 A1 5/2012 Caballero et al.
2012/0112970 A1 5/2012 Caballero et al.
2012/0146865 A1 6/2012 Hayashi
2012/0169552 A1 7/2012 Lee et al.
2012/0176292 A1 7/2012 Hung et al.
2012/0229347 A1 * 9/2012 Jin ..... H01Q 1/243 343/702
2012/0231750 A1 9/2012 Jin et al.
2012/0299785 A1 11/2012 Bevelacqua
2013/0050046 A1 2/2013 Jarvis et al.
2013/0102357 A1 4/2013 Vance
2013/0169490 A1 7/2013 Pascolini et al.
2013/0201067 A1 8/2013 Hu et al.
2014/0062815 A1 3/2014 Tsai et al.
2014/0266923 A1 9/2014 Zhou et al.
2014/0292598 A1 10/2014 Bevelacqua et al.
2014/0306857 A1 10/2014 Bevelacqua et al.
2014/0333495 A1 11/2014 Vazquez et al.
2014/0333496 A1 11/2014 Hu et al.
2015/0061952 A1 3/2015 Chiang et al.

FOREIGN PATENT DOCUMENTS

CN 102684722 9/2012
EP 0 892 459 1/1999
EP 1 146 590 10/2001
EP 1 168 496 1/2002
EP 1363360 11/2003
EP 1 387 435 2/2004
EP 1501154 4/2007
EP 2178167 4/2010
EP 2182577 5/2010
EP 2234207 9/2010
EP 2328233 1/2011
EP 2405534 1/2012

(56) References Cited

FOREIGN PATENT DOCUMENTS

| | | |
|---|---|---|
| EP | 2528165 | 11/2012 |
| JP | 09093029 | 4/1997 |
| JP | 2000332530 | 11/2000 |
| JP | 2005159813 | 6/2005 |
| JP | 2005167730 | 6/2005 |
| WO | 01/29927 | 4/2001 |
| WO | 0199230 | 12/2001 |
| WO | 02054534 | 7/2002 |
| WO | 2006114771 | 11/2006 |
| WO | 2007012697 | 2/2007 |
| WO | 2011050845 | 5/2011 |
| WO | 2011158057 | 12/2011 |

* cited by examiner

ANTENNA SYSTEM HAVING TWO ANTENNAS AND THREE PORTS

BACKGROUND

This relates generally to electronic devices, and more particularly, to antennas for electronic devices with wireless communications circuitry.

Electronic devices such as portable computers and cellular telephones are often provided with wireless communications capabilities. For example, electronic devices may use long-range wireless communications circuitry such as cellular telephone circuitry to communicate using cellular telephone bands. Electronic devices may use short-range wireless communications circuitry such as wireless local area network communications circuitry to handle communications with nearby equipment. Electronic devices may also be provided with satellite navigation system receivers and other wireless circuitry.

To satisfy consumer demand for small form factor wireless devices, manufacturers are continually striving to implement wireless communications circuitry such as antenna components using compact structures. At the same time, it may be desirable to include conductive structures in an electronic device such as metal device housing components. Because conductive components can affect radio-frequency performance, care must be taken when incorporating antennas into an electronic device that includes conductive structures. Moreover, care must be taken to ensure that the antennas and wireless circuitry in a device are able to exhibit satisfactory performance over a range of operating frequencies.

It would therefore be desirable to be able to provide improved wireless communications circuitry for wireless electronic devices.

SUMMARY

An electronic device may include radio-frequency transceiver circuitry and antenna structures. The antenna structures may have multiple antenna ports such as first, second, and third ports. The transceiver circuitry may include a satellite navigation system receiver, a wireless local area network transceiver, and a cellular transceiver for handling cellular voice and data traffic.

A duplexer may be coupled to the third port. The wireless local area network transceiver may have a port that is coupled to the duplexer. The cellular transceiver may also have a port that is coupled to the duplexer. The satellite navigation system receiver may be coupled to the second port. The cellular transceiver may be coupled to the first port.

The antenna structures may include an inverted-F antenna resonating element that forms an inverted-F antenna with an antenna ground. The antenna structures may also include a monopole antenna resonating element that forms a monopole antenna with the antenna ground. The first and second antenna ports may be formed by signal lines that are coupled to the inverted-F antenna resonating element at different locations. The third antenna port may be coupled to the monopole antenna resonating element.

A first adjustable capacitor may be coupled to the first port of the inverted-F antenna to tune the inverted-F antenna. For example, the first adjustable capacitor may be used to tune the antenna structures to cover a desired range of cellular communications.

An additional adjustable capacitor may be coupled to the third port to tune the monopole antenna. For example, the additional adjustable capacitor may be used to ensure that the monopole antenna can be used in handling wireless local area network frequencies and cellular frequencies of interest.

Further features of the invention, its nature and various advantages will be more apparent from the accompanying drawings and the following detailed description of the preferred embodiments.

DETAILED DESCRIPTION

Figure 1:
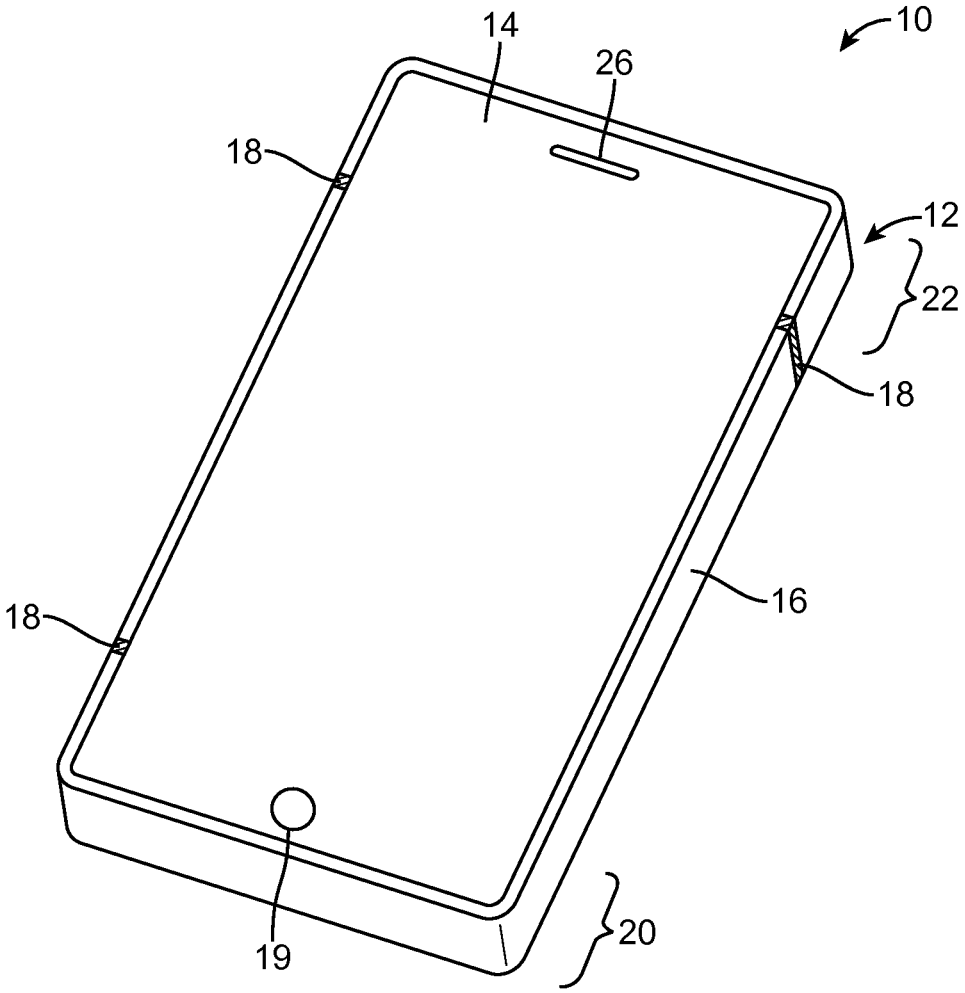
FIG. 1 is a perspective view of an illustrative electronic device with wireless communications circuitry in accordance with an embodiment of the present invention.

Electronic devices such as electronic device 10 of FIG. 1 may be provided with wireless communications circuitry. The wireless communications circuitry may be used to support wireless communications in multiple wireless communications bands. The wireless communications circuitry may include one or more antennas.

The antennas can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures. The conductive electronic device structures may include conductive housing structures. The housing structures may include peripheral structures such as a peripheral conductive member that runs around the periphery of an electronic device. The peripheral conductive member may serve as a bezel for a planar structure such as a display, may serve as sidewall structures for a device housing, and/or may form other housing structures. Gaps in the peripheral conductive member may be associated with the antennas.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a cellular telephone, or a media player. Device 10 may also be a television, a set-top box, a desktop computer, a computer monitor into which a computer has been integrated, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may, for example, be a touch screen that incorporates capacitive touch electrodes. Display 14 may include image pixels formed from light-emitting diodes (LEDs), organic LEDs (OLEDs), plasma cells, electrowetting pixels, electrophoretic pixels, liquid crystal display (LCD) components, or other suitable image pixel structures. A display cover layer such as a layer of clear glass or plastic may cover the surface of display 14. Buttons such as button 19 may pass through openings in the cover layer. The cover layer may also have other openings such as an opening for speaker port 26.

Housing 12 may include peripheral housing structures such as structures 16. Structures 16 may run around the periphery of device 10 and display 14. In configurations in which device 10 and display 14 have a rectangular shape, structures 16 may be implemented using a peripheral housing member have a rectangular ring shape (as an example). Peripheral structures 16 or part of peripheral structures 16 may serve as a bezel for display 14 (e.g., a cosmetic trim that surrounds all four sides of display 14 and/or helps hold display 14 to device 10). Peripheral structures 16 may also, if desired, form sidewall structures for device 10 (e.g., by forming a metal band with vertical sidewalls, etc.).

Peripheral housing structures 16 may be formed of a conductive material such as metal and may therefore sometimes be referred to as peripheral conductive housing structures, conductive housing structures, peripheral metal structures, or a peripheral conductive housing member (as examples). Peripheral housing structures 16 may be formed from a metal such as stainless steel, aluminum, or other suitable materials. One, two, or more than two separate structures may be used in forming peripheral housing structures 16.

It is not necessary for peripheral housing structures 16 to have a uniform cross-section. For example, the top portion of peripheral housing structures 16 may, if desired, have an inwardly protruding lip that helps hold display 14 in place. If desired, the bottom portion of peripheral housing structures 16 may also have an enlarged lip (e.g., in the plane of the rear surface of device 10). In the example of FIG. 1, peripheral housing structures 16 have substantially straight vertical sidewalls. This is merely illustrative. The sidewalls formed by peripheral housing structures 16 may be curved or may have other suitable shapes. In some configurations (e.g., when peripheral housing structures 16 serve as a bezel for display 14), peripheral housing structures 16 may run around the lip of housing 12 (i.e., peripheral housing structures 16 may cover only the edge of housing 12 that surrounds display 14 and not the rest of the sidewalls of housing 12).

If desired, housing 12 may have a conductive rear surface. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a rear housing wall of device 10 may be formed from a planar metal structure and portions of peripheral housing structures 16 on the left and right sides of housing 12 may be formed as vertically extending integral metal portions of the planar metal structure. Housing structures such as these may, if desired, be machined from a block of metal.

Display 14 may include conductive structures such as an array of capacitive electrodes, conductive lines for addressing pixel elements, driver circuits, etc. Housing 12 may include internal structures such as metal frame members, a planar housing member (sometimes referred to as a midplate) that spans the walls of housing 12 (i.e., a substantially rectangular sheet formed from one or more parts that is welded or otherwise connected between opposing sides of member 16), printed circuit boards, and other internal conductive structures. These conductive structures may be located in the center of housing 12 under display 14 (as an example).

In regions 22 and 20, openings may be formed within the conductive structures of device 10 (e.g., between peripheral conductive housing structures 16 and opposing conductive structures such as conductive housing midplate or rear housing wall structures, a conductive ground plane associated with a printed circuit board, and conductive electrical components in device 10). These openings, which may sometimes be referred to as gaps, may be filled with air, plastic, and other dielectrics. Conductive housing structures and other conductive structures in device 10 may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22.

In general, device 10 may include any suitable number of antennas (e.g., one or more, two or more, three or more, four or more, etc.). The antennas in device 10 may be located at opposing first and second ends of an elongated device housing, along one or more edges of a device housing, in the center of a device housing, in other suitable locations, or in one or more of such locations. The arrangement of FIG. 1 is merely illustrative.

Portions of peripheral housing structures 16 may be provided with gap structures. For example, peripheral housing structures 16 may be provided with one or more gaps such as gaps 18, as shown in FIG. 1. The gaps in peripheral housing structures 16 may be filled with dielectric such as polymer, ceramic, glass, air, other dielectric materials, or combinations of these materials. Gaps 18 may divide peripheral housing structures 16 into one or more peripheral conductive segments. There may be, for example, two peripheral conductive segments in peripheral housing structures 16 (e.g., in an arrangement with two gaps), three peripheral conductive segments (e.g., in an arrangement with three gaps), four peripheral conductive segments (e.g., in an arrangement with four gaps, etc.). The segments of peripheral conductive housing structures 16 that are formed in this way may form parts of antennas in device 10.

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
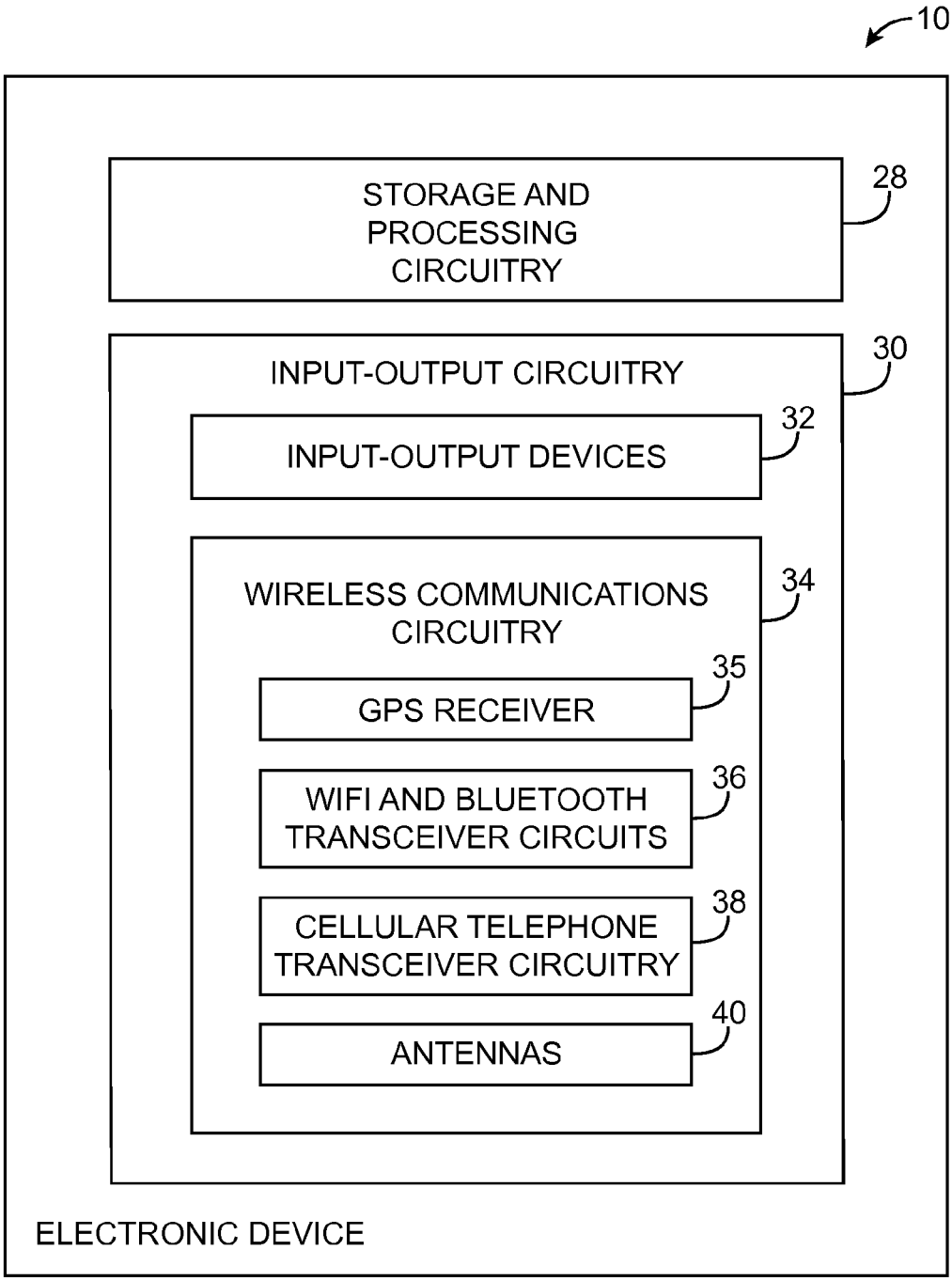
FIG. 2 is a schematic diagram of an illustrative electronic device with wireless communications circuitry in accordance with an embodiment of the present invention.

A schematic diagram of an illustrative configuration that may be used for electronic device 10 is shown in FIG. 2. As shown in FIG. 2, electronic device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. The processing circuitry may be based on one or more microprocessors, microcontrollers, digital signal processors, baseband processors, power management units, audio codec chips, application specific integrated circuits, etc.

Storage and processing circuitry 28 may be used to run software on device 10, such as internet browsing applications, voice-over-internet-protocol (VoIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, etc.

Circuitry 28 may be configured to implement control algorithms that control the use of antennas in device 10. For example, circuitry 28 may perform signal quality monitoring operations, sensor monitoring operations, and other data gathering operations and may, in response to the gathered data and information on which communications bands are to be used in device 10, control which antenna structures within device 10 are being used to receive and process data and/or may adjust one or more switches, tunable elements, or other adjustable circuits in device 10 to adjust antenna performance. As an example, circuitry 28 may control which of two or more antennas is being used to receive incoming radio-frequency signals, may control which of two or more antennas is being used to transmit radio-frequency signals, may control the process of routing incoming data streams over two or more antennas in device 10 in parallel, may tune an antenna to cover a desired communications band, etc.

In performing these control operations, circuitry 28 may open and close switches, may turn on and off receivers and transmitters, may adjust impedance matching circuits, may configure switches in front-end-module (FEM) radio-frequency circuits that are interposed between radio-frequency transceiver circuitry and antenna structures (e.g., filtering and switching circuits used for impedance matching and signal routing), may adjust switches, tunable circuits, and other adjustable circuit elements that are formed as part of an antenna or that are coupled to an antenna or a signal path associated with an antenna, and may otherwise control and adjust the components of device 10.

Input-output circuitry 30 may be used to allow data to be supplied to device 10 and to allow data to be provided from device 10 to external devices. Input-output circuitry 30 may include input-output devices 32. Input-output devices 32 may include touch screens, buttons, joysticks, click wheels, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 32 and may receive status information and other output from device 10 using the output resources of input-output devices 32.

Wireless communications circuitry 34 may include radio-frequency (RF) transceiver circuitry formed from one or more integrated circuits, power amplifier circuitry, low-noise input amplifiers, passive RF components, one or more antennas, filters, duplexers, and other circuitry for handling RF wireless signals. Wireless signals can also be sent using light (e.g., using infrared communications).

Wireless communications circuitry 34 may include satellite navigation system receiver circuitry such as Global Positioning System (GPS) receiver circuitry 35 (e.g., for receiving satellite positioning signals at 1575 MHz) or satellite navigation system receiver circuitry associated with other satellite navigation systems. Wireless local area network transceiver circuitry such as transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in cellular telephone bands such as bands in frequency ranges of about 700 MHz to about 2700 MHz or bands at higher or lower frequencies. Wireless communications circuitry 34 can include circuitry for other short-range and long-range wireless links if desired. For example, wireless communications circuitry 34 may include wireless circuitry for receiving radio and television signals, paging circuits, etc. Near field communications may also be supported (e.g., at 13.56 MHz). In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may have antenna structures such as one or more antennas 40. Antennas structures 40 may be formed using any suitable antenna types. For example, antennas structures 40 may include antennas with resonating elements that are formed from loop antenna structures, patch antenna structures, inverted-F antenna structures, dual arm inverted-F antenna structures, closed and open slot antenna structures, planar inverted-F antenna structures, helical antenna structures, strip antennas, monopoles, dipoles, hybrids of these designs, etc. Different types of antennas may be used for different bands and combinations of bands. For example, one type of antenna may be used in forming a local wireless link antenna and another type of antenna may be used in forming a remote wireless link. Antenna structures in device 10 such as one or more of antennas 40 may be provided with one or more antenna feeds, fixed and/or adjustable components, and optional parasitic antenna resonating elements so that the antenna structures cover desired communications bands.

Figure 3:
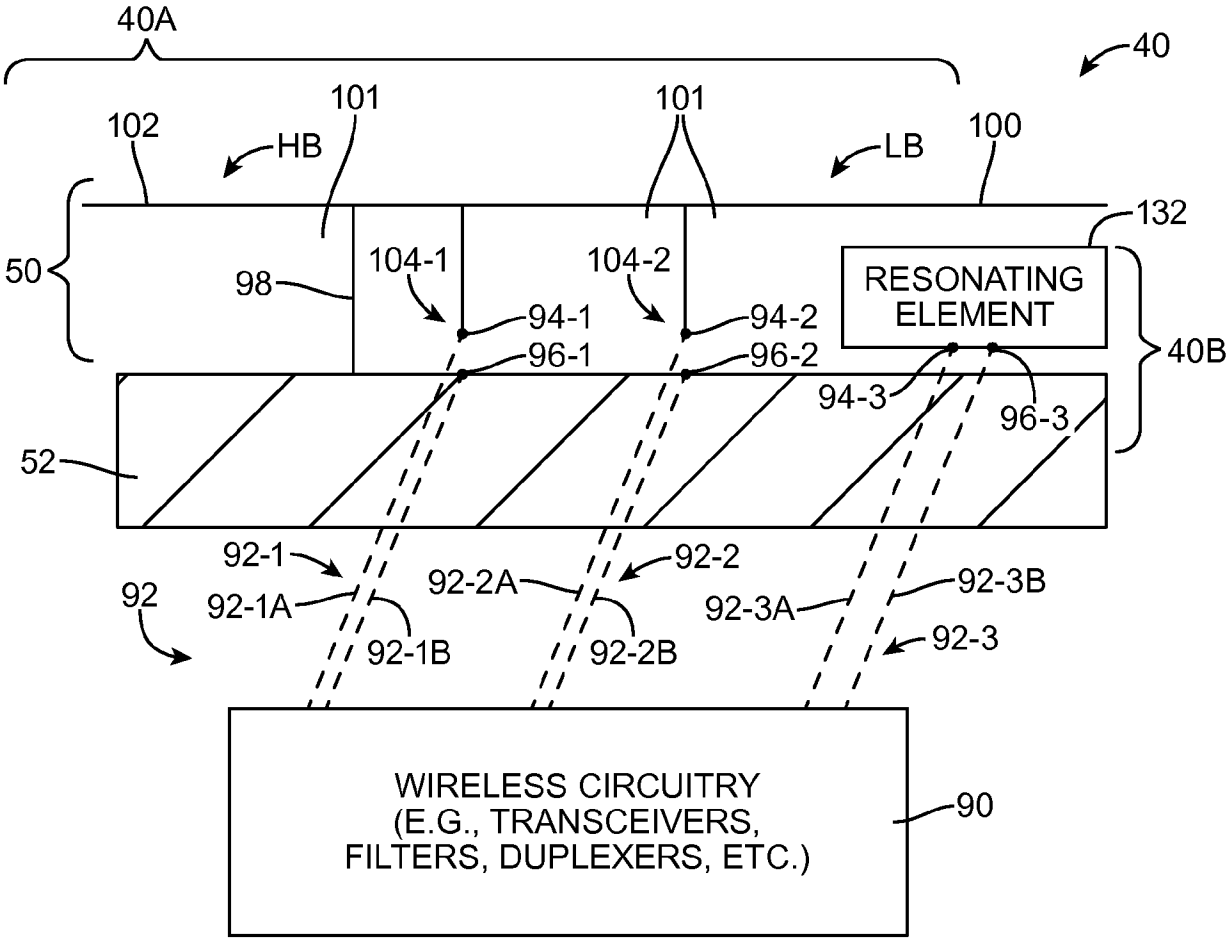
FIG. 3 is a diagram of an illustrative tunable antenna in accordance with an embodiment of the present invention.

Illustrative antenna structures of the type that may be used in device 10 (e.g., in region 20 and/or region 22) are shown in FIG. 3. Antenna structures 40 of FIG. 3 include an antenna resonating element of the type that is sometimes referred to as a dual arm inverted-F antenna resonating element or T antenna resonating element. As shown in FIG. 3, antenna structures 40 may have conductive antenna structures such as dual arm inverted-F antenna resonating element 50, optional additional antenna resonating element 132 (which may operate as a near-field coupled parasitic antenna resonating element and/or a directly fed antenna resonating element), and antenna ground 52. The conductive structures that form antenna resonating element 50, antenna resonating element 132, and antenna ground 52 may be formed from parts of conductive housing structures, from parts of electrical device components in device 10, from printed circuit board traces, from strips of conductor such as strips of wire and metal foil, or may be formed using other conductive structures.

Antenna resonating element 50 and antenna ground 52 may form first antenna structures 40A (e.g., a first antenna such as a dual arm inverted-F antenna). Resonating element 132 and antenna ground 52 may form second antenna structures 40B (e.g., a second antenna). If desired, resonating element 132 may also form a parasitic antenna resonating element (e.g., an element that is not directly fed). Resonating element 132 may, for example, form a parasitic antenna element that contributes to the response of antenna 40A during operation of antenna structures 40 at certain frequencies.

As shown in FIG. 3, transceiver circuitry 90 may be coupled to antenna 40 using transmission line structures such as transmission line 92. Transmission line 92 may have positive signal path 92A and ground signal path 92B. Paths 92A and 92B may be formed from metal traces on rigid printed circuit boards, may be formed from metal traces on flexible printed circuits, may be formed on dielectric support structures such as plastic, glass, and ceramic members, may be formed as part of a cable, etc. Transmission line 92 may be formed using one or more microstrip transmission lines, stripline transmission lines, edge coupled microstrip transmission lines, edge coupled stripline transmission lines, coaxial cables, or other suitable transmission line structures. Circuits such as impedance matching circuits, filters, switches, duplexers, diplexers, and other circuitry may, if desired, be interposed in transmission line path 92.

Transmission line structures 92 may be coupled to antenna ports formed using antenna port terminals 94-1 and 96-1 (which form a first antenna port), antenna port terminals 94-2 and 96-2 (which form a second antenna port), and antenna port terminals 94-3 and 96-3 (which form a third antenna port). The antenna ports may sometimes be referred to as antenna feeds. For example, terminal 94-1 may be a positive antenna feed terminal and terminal 96-1 may be a ground antenna feed terminal for a first antenna feed, terminal 94-2 may be a positive antenna feed terminal and terminal 96-2 may be a ground antenna feed terminal for a second antenna feed, and terminal 94-3 may be a positive antenna feed terminal and terminal 96-3 may be a ground antenna feed terminal for a third antenna feed.

Each antenna port in antenna structures 40 may be used in handling a different type of wireless signals. For example, the first port may be used for transmitting and/or receiving antenna signals in a first communications band or first set of communications bands, the second port may be used for transmitting and/or receiving antenna signals in a second communications band or second set of communications bands, and the third port may be used for transmitting and/or receiving antenna signals in a third communications band or third set of communications bands.

If desired, tunable components such as adjustable capacitors, adjustable inductors, filter circuitry, switches, impedance matching circuitry, duplexers, and other circuitry may be interposed within transmission line paths (i.e., between wireless circuitry 90 and the respective ports of antenna structures 40). The different ports in antenna structures 40 may each exhibit a different impedance and antenna resonance behavior as a function of operating frequency. Wireless circuitry 90 may therefore use different ports for different types of communications. As an example, signals associated with communicating in one or more cellular communications band may be transmitted and received using one of the ports, whereas reception of satellite navigation system signals may be handled using a different one of the ports.

Antenna resonating element 50 may include a short circuit branch such as branch 98 that couples resonating element arm structures such as arms 100 and 102 to antenna ground 52. Dielectric gap 101 separates arms 100 and 102 from antenna ground 52. Antenna ground 52 may be formed from housing structures such as a metal midplate member, printed circuit traces, metal portions of electronic components, or other conductive ground structures. Gap 101 may be formed by air, plastic, and other dielectric materials. Short circuit branch 98 may be implemented using a strip of metal, a metal trace on a dielectric support structure such as a printed circuit or plastic carrier, or other conductive path that bridges gap 101 between resonating element arm structures (e.g., arms 102 and/or 100) and antenna ground 52.

The antenna port formed from terminals 94-1 and 96-1 may be coupled in a path such as path 104-1 that bridges gap 101. The antenna port formed from terminals 94-2 and 96-2 may be coupled in a path such as path 104-2 that bridges gap 101 in parallel with path 104-1 and short circuit path 98.

Resonating element arms 100 and 102 may form respective arms in a dual arm inverted-F antenna resonating element. Arms 100 and 102 may have one or more bends. The illustrative arrangement of FIG. 3 in which arms 100 and 102 run parallel to ground 52 is merely illustrative.

Arm 100 may be a (longer) low-band arm that handles lower frequencies, whereas arm 102 may be a (shorter) high-band arm that handles higher frequencies. Low-band arm 100 may allow antenna 40 to exhibit an antenna resonance at low band (LB) frequencies such as frequencies from 700 MHz to 960 MHz or other suitable frequencies. High-band arm 102 may allow antenna 40 to exhibit one or more antenna resonances at high band (HB) frequencies such as resonances at one or more ranges of frequencies between 960 MHz to 2700 MHz or other suitable frequencies. Antenna resonating element 101 may also exhibit an antenna resonance at 1575 MHz or other suitable frequency for supporting satellite navigation system communications such as Global Positioning System communications.

Antenna resonating element 132 may be used to support communications at additional frequencies (e.g., frequencies associated with a 2.4 GHz communications band such as an IEEE 802.11 wireless local area network band, a 5 GHz communications band such as an IEEE 802.11 wireless local area network band, and/or cellular frequencies such as frequencies in cellular bands near 2.4 GHz).

Antenna resonating element 132 may be based on a monopole antenna resonating element structure that forms a monopole antenna using antenna ground 52 or may be formed from other antenna resonating element structures. Antenna resonating element 132 may be formed from strips of metal (e.g., stamped metal foil), metal traces on a flexible printed circuit (e.g., a printed circuit formed from a flexible substrate such as a layer of polyimide or a sheet of other polymer material), metal traces on a rigid printed circuit board substrate (e.g., a substrate formed from a layer of fiberglass-filled epoxy), metal traces on a plastic carrier, patterned metal on glass or ceramic support structures, wires, electronic device housing structures, metal parts of electrical components in device 10, or other conductive structures.

To provide antenna 40 with tuning capabilities, antenna 40 may include adjustable circuitry. The adjustable circuitry may be coupled between different locations on antenna resonating element 50, may be coupled between different locations on resonating element 132, may form part of paths such as paths 104-1 and 104-2 that bridge gap 101, may form part of transmission line structures 92 (e.g., circuitry interposed within one or more of the conductive lines in path 92-1, path 92-2, and/or path 92-3), or may be incorporated elsewhere in antenna structures 40, transmission line paths 92, and wireless circuitry 90.

The adjustable circuitry may be tuned using control signals from control circuitry 28 (FIG. 2). Control signals from control circuitry 28 may, for example, be provided to an adjustable capacitor, adjustable inductor, or other adjustable circuit using a control signal path that is coupled between control circuitry 28 and the adjustable circuit. Control circuitry 28 may provide control signals to adjust a capacitance exhibited by an adjustable capacitor, may provide control signals to adjust the inductance exhibited by an adjustable inductor, may provide control signals that adjust the impedance of a circuit that includes one or more components such fixed and variable capacitors, fixed and variable inductors, switching circuitry for switching electrical components such as capacitors and inductors into and out of use, resistors, and other adjustable circuitry, or may provide control signals to other adjustable circuitry for tuning the frequency response of antenna structures 40. As an example, antenna structures 40 may be provided with first and second adjustable capacitors. By selecting a desired capacitance value for each adjustable capacitor using control signals from control circuitry 28, antenna structures 40 can be tuned to cover operating frequencies of interest.

If desired, the adjustable circuitry of antenna structures 40 may include one or more adjustable circuits that are coupled to antenna resonating element structures 50 such as arms 102 and 100 in antenna resonating element 50, one or more adjustable circuits that are coupled to a monopole antenna resonating element (e.g., resonating element 132), one or more adjustable circuits that are interposed within the signal lines associated with one or more of the ports for antenna structures 40 (e.g., paths 104-1, 104-2, paths 92, etc.).

Figure 4:
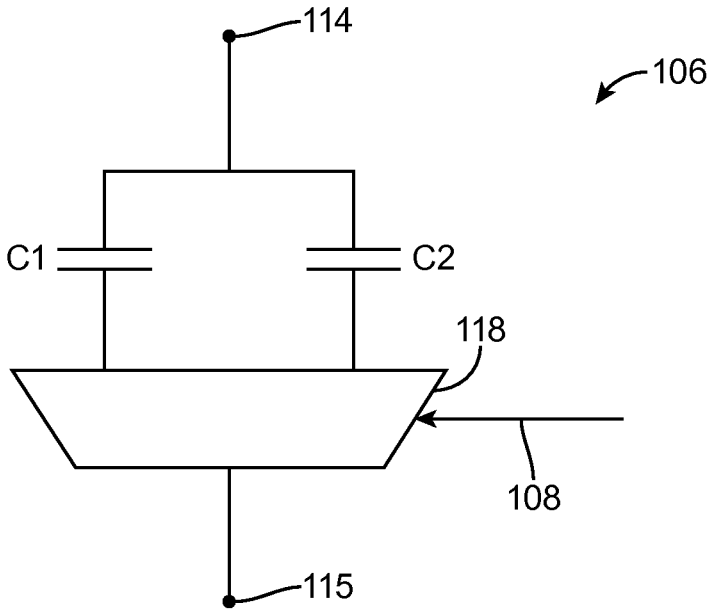
FIG. 4 is a diagram of an illustrative adjustable capacitor of the type that may be used in tuning antenna structures in an electronic device in accordance with an embodiment of the present invention.

FIG. 4 is a schematic diagram of an illustrative adjustable capacitor circuit of the type that may be used in tuning antenna structures 40. Adjustable capacitor 106 of FIG. 4 produces an adjustable amount of capacitance between terminals 114 and 115 in response to control signals provided to input path 108. Switching circuitry 118 has two terminals coupled respectively to capacitors C1 and C2 and has another terminal coupled to terminal 115 of adjustable capacitor 106. Capacitor C1 is coupled between terminal 114 and one of the terminals of switching circuitry 118. Capacitor C2 is coupled between terminal 114 and the other terminal of switching circuitry 118 in parallel with capacitor C1. By controlling the value of the control signals supplied to control input 108, switching circuitry 118 may be configured to produce a desired capacitance value between terminals 114 and 115. For example, switching circuitry 118 may be configured to switch capacitor C1 into use or may be configured to switch capacitor C2 into use.

If desired, switching circuitry 118 may include one or more switches or other switching resources that selectively decouple capacitors C1 and C2 (e.g., by forming an open circuit so that the path between terminals 114 and 115 is an open circuit and both capacitors are switched out of use). Switching circuitry 118 may also be configured (if desired) so that both capacitors C1 and C2 can be simultaneously switched into use. Other types of switching circuitry 118 such as switching circuitry that exhibits fewer switching states or more switching states may be used if desired. Adjustable capacitors such as adjustable capacitor 106 may also be implemented using variable capacitor devices (sometimes referred to as varactors). Adjustable capacitors such as capacitor 106 may include two capacitors, three capacitors, four capacitors, or other suitable numbers of capacitors. The configuration of FIG. 4 is merely illustrative.

During operation of device 10, control circuitry such as storage and processing circuitry 28 of FIG. 2 may make antenna adjustments by providing control signals to adjustable components such as one or more adjustable capacitors 106. If desired, control circuitry 28 may also make antenna tuning adjustments using adjustable inductors or other adjustable circuitry. Antenna frequency response adjustments may be made in real time in response to information identifying which communications bands are active, in response to feedback related to signal quality or other performance metrics, in response to sensor information, or based on other information.

Figure 5:
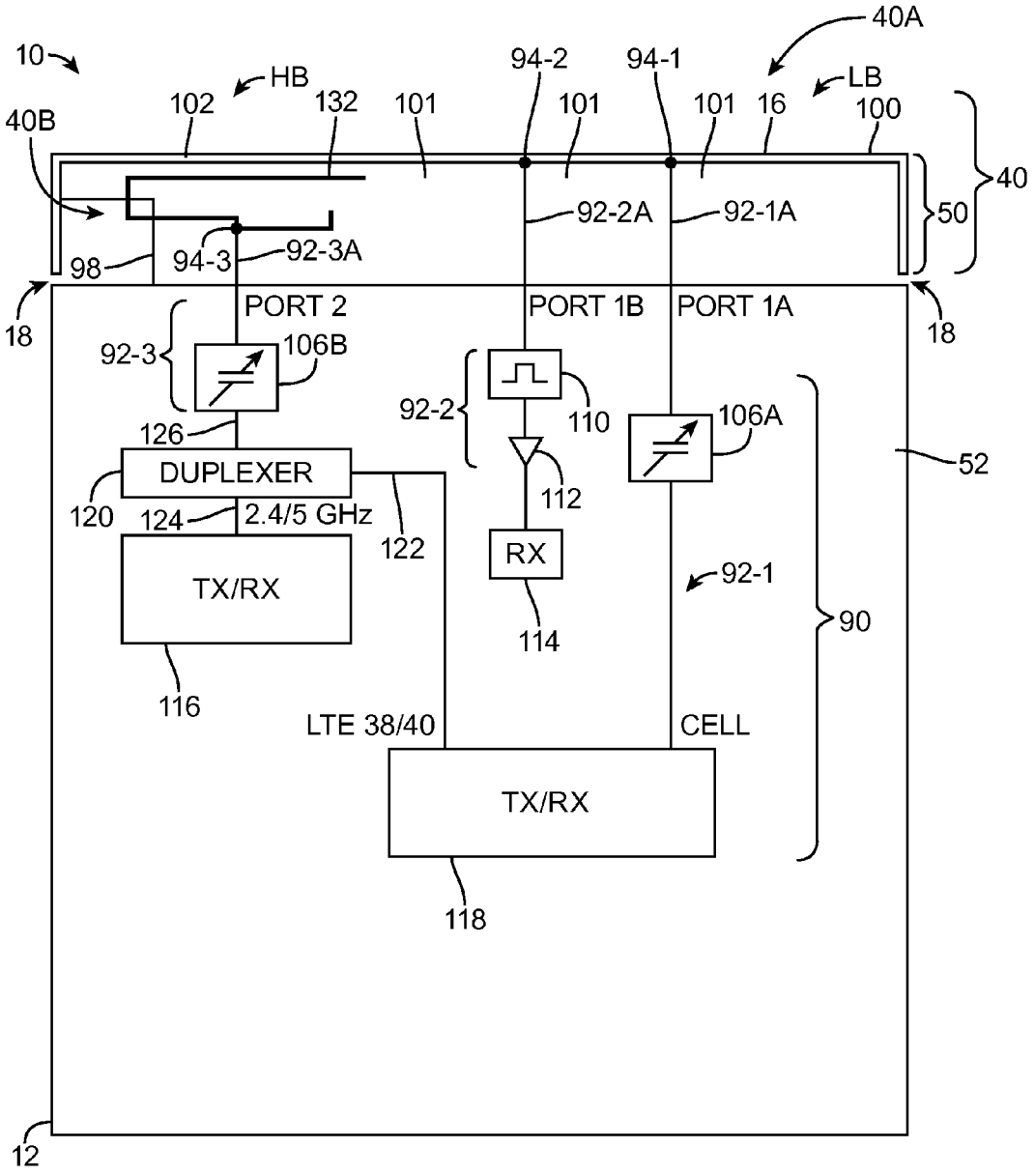
FIG. 5 is a diagram of illustrative electronic device antenna structures having a dual arm inverted-F antenna resonating element with two antenna ports that is formed from a housing structure and having a monopole antenna resonating element coupled to another antenna port in accordance with an embodiment of the present invention.

FIG. 5 is a diagram of an electronic device with illustrative adjustable antenna structures 40. In the illustrative configuration of FIG. 5, electronic device 10 has adjustable antenna structures 40 that are implemented using conductive housing structures in electronic device 10. As shown in FIG. 5, antenna structures 40 include antenna resonating element 132 and antenna resonating element 50. Antenna resonating element 132 may be a monopole antenna resonating element. Antenna resonating element 132 and antenna ground 52 may form antenna 40B (e.g., a monopole antenna). Antenna resonating element 50 may be a dual arm inverted-F antenna resonating element. Antenna resonating element 50 and antenna ground 52 may form antenna 40A (e.g., a dual arm inverted-F antenna).

Arms 100 and 102 of dual arm inverted-F antenna resonating element 50 may be formed from portions of peripheral conductive housing structures 16. Resonating element arm portion 102 of resonating element 50 in antenna 40A produces an antenna response in a high band (HB) frequency range and resonating element arm portion 100 produces an antenna response in a low band (LB) frequency range. Antenna ground 52 may be formed from sheet metal (e.g., one or more housing midplate members and/or a rear housing wall in housing 12), may be formed from portions of printed circuits, may be formed from conductive device components, or may be formed from other metal portions of device 10.

As described in connection with FIG. 3, antenna structures 40 may have three antenna ports. Port 1A may be coupled to the antenna resonating element arms of dual arm antenna resonating element 50 at a first location along member 16 (see, e.g., path 92-1A, which is coupled to member 16 at terminal 94-1). Port 1B may be coupled to the antenna resonating element arm structures of dual arm antenna resonating element 50 at a second location that is different than the first location (see, e.g., path 92-2A, which is coupled to member 16 at terminal 94-2).

Adjustable capacitor 106A (e.g., a capacitor of the type shown in FIG. 4) may be interposed in path 94-1A and coupled to port 1A for use in tuning antenna structures 40 (e.g., for tuning dual arm inverted-F antenna 40A). Global positioning system (GPS) signals may be received using port 1B of antenna 40A. Transmission line path 92-2 may be coupled between port 1B and satellite navigation system receiver 114 (e.g., a Global Positioning System receiver such as satellite navigation system receiver 35 of FIG. 2). Circuitry such as band pass filter 110 and amplifier 112 may, if desired, be interposed within transmission line path 92-2. During operation, satellite navigation system signals may pass from antenna 40A to receiver 114 via filter 110 and amplifier 112.

Antenna resonating element 50 may cover frequencies such as frequencies in a low band (LB) communications band extending from about 700 MHz to 960 MHz and, if desired, a high band (HB) communications band extending from about 1.7 to 2.2 GHz (as examples). Adjustable capacitor 106A may be used in tuning low band performance in band LB, so that all desired frequencies between 700 MHz and 960 MHz can be covered.

Port 2 may use signal line 92-3A to feed antenna resonating element 132 of antenna 40B at feed terminal 94-3. In the illustrative arrangement of FIG. 5, antenna resonating element 132 is a monopole antenna resonating element in monopole antenna 40B. Monopole antenna resonating element 132 has two branches that are used in forming a dual-band antenna with antenna ground 52. The dual-band monopole antenna may exhibit a resonance at a communications band at 5 GHz (e.g., for handling 5 GHz wireless local area network communications) and a resonance at a communications band at 2.4 GHz. Antenna response in the 2.4 GHz band may be tuned using adjustable capacitor 106A (e.g. a capacitor of the type shown in FIG. 4). By tuning the monopole antenna formed from antenna resonating element 132, the monopole antenna may be adjusted to cover a range of desired frequencies in a band that extends from a low frequency of about 2.3 GHz to a high frequency of about 2.7 GHz (as an example). This allows the monopole antenna to cover both wireless local area network traffic at 2.4 GHz and some of the cellular traffic for device 10.

Wireless circuitry 90 may include satellite navigation system receiver 114 and radio-frequency transceiver circuitry such as radio-frequency transceiver circuitry 116 and 118. Receiver 114 may be a Global Positioning System receiver or other satellite navigation system receiver (e.g., receiver 35 of FIG. 2). Transceiver 116 may be a wireless local area network transceiver such as radio-frequency transceiver 36 of FIG. 2 that operates in bands such as a 2.4 GHz band and a 5 GHz band. Transceiver 116 may be, for example, an IEEE 802.11 radio-frequency transceiver (sometimes referred to as a WiFi® transceiver). Transceiver 118 may be a cellular transceiver such as cellular transceiver 38 of FIG. 2 that is configured to handle voice and data traffic in one or more cellular bands. Examples of cellular bands that may be covered include a band (e.g., low band LB) ranging from 700 MHz to 960 MHz, a band (e.g., a high band HB) ranging from about 1.7 to 2.2 GHz), and Long Term Evolution (LTE) bands 38 and 40.

Long Term Evolution band 38 is associated with frequencies of about 2.6 GHz. Long Term Evolution band 40 is associated with frequencies of about 2.3 to 2.4 GHz. Port CELL of transceiver 118 may be used to handle cellular signals in band LB (700 MHz to 960 MHz) and, if desired, in band HB (1.7 to 2.2 GHz). Port CELL is coupled to port 1A of antenna structures 40. Port LTE 38/40 of transceiver 118 is used to handle communications in LTE band 38 and LTE band 40. As shown in FIG. 5, port LTE 38/40 of transceiver 118 may be coupled to port 122 of duplexer 120. Port 124 of duplexer 120 may be coupled to the input-output port of transceiver 116, which handles WiFi® signals at 2.4 and 5 GHz.

Duplexer 120 uses frequency multiplexing to route the signals between ports 122 and 124 and shared duplexer port 126. Port 126 is coupled to transmission line path 92-3. With this arrangement, 2.4 GHz and 5 GHz WiFi® signals associated with port 124 of duplexer 120 and transceiver 116 may be routed to and from path 92-3 and LTE band 38/40 signals associated with port 122 of duplexer 120 and port LTE 38/40 of transceiver 118 may be routed to and from path 92-3. Adjustable capacitor 106B can be coupled between duplexer 120 and antenna resonating element 132. During operation of device 10, adjustable capacitor 106B can be adjusted to tune the monopole antenna formed from antenna resonating element 132 as needed to handle the 2.4/5 GHz traffic associated with port 124 and the LTE band 38/40 traffic associated with port 122.

Figure 6:
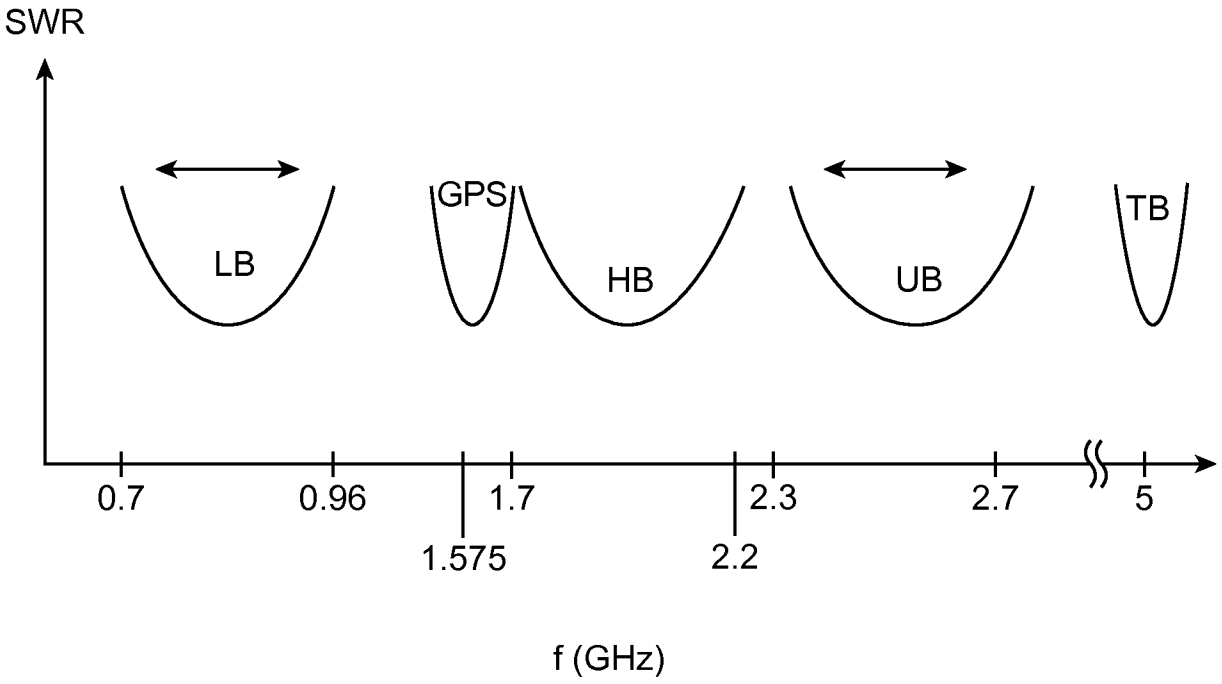
FIG. 6 is a graph of antenna performance as a function of frequency for a tunable antenna of the type shown in FIG. 5 in accordance with an embodiment of the present invention.

FIG. 6 is a graph in which antenna performance (standing wave ratio SWR) has been plotted as a function of operating frequency for a device with antenna structures such as antenna structures 40 of FIG. 5. As shown in FIG. 6, antenna structures 40 may exhibit a resonance at band LB using port 1A. Adjustable capacitor 106A may be adjusted to adjust the position of the LB resonance, thereby covering all frequencies of interest (e.g., all frequencies in a range of about 0.7 GHz to 0.96 GHz, as an example). When using port 1B, antenna structures 40 may exhibit a resonance at a satellite navigation system frequency such as a 1.575 GHz resonance for handling Global Positioning System signals. Band HB (e.g., a cellular band from 1.7 to 2.2 GHz) may optionally be covered using port 1A (with our without using adjustable capacitor 106A to cover frequencies of interest).

Using port 2 and the monopole antenna formed from antenna resonating element 132 and antenna ground 52, antenna structures 40 may cover communications band UB. Adjustable capacitor 106B may be adjusted to tune the position of the UB antenna resonance, thereby ensuring that the UB resonance can cover all desired frequencies of interest (e.g., frequencies ranging from 2.3 GHz to 2.7 GHz, as an example). For example, adjustable capacitor 106B may be adjusted to ensure that 2.3-2.4 GHz LTE band 40 signals from port 122 can be covered, to ensure that 2.4 GHz WiFi® signals from port 124 can be handled, and to ensure that 2.6 GHz LTE band 38 signals from port 122 can be handled. Band TB (e.g., a band at 5 GHz for handling 5 GH WiFi® signals from port 124) may be covered using the monopole antenna formed from antenna resonating element 132 and antenna ground 52.

The foregoing is merely illustrative of the principles of this invention and various modifications can be made by those skilled in the art without departing from the scope and spirit of the invention.

What is claimed is:

1. Electronic device antenna structures, comprising:

an antenna ground;

a first antenna resonating element that forms a first antenna with the antenna ground, wherein the first antenna has first and second ports;

a second antenna resonating element that forms a second antenna with the antenna ground that is separate from the first antenna and that has a third port;

radio-frequency transceiver circuitry that receives radio-frequency signals in a first frequency band over the first port and that receives radio frequency signals in a second frequency band that is different from the first frequency band over the third port; and band pass filter circuitry coupled to the second port, wherein the band pass filter circuitry is configured to pass satellite navigation signals in a satellite navigation frequency band from the second port to the radio-frequency transceiver circuitry and the first and second frequency bands are different from the satellite navigation frequency band.

2. The electronic device antenna structures defined in claim 1 wherein the first antenna resonating element comprises an inverted-F antenna resonating element.

3. The electronic device antenna structures defined in claim 2 further comprising an adjustable capacitor coupled to the first port, wherein the adjustable capacitor is configured to tune the first antenna.

4. The electronic device antenna structures defined in claim 1 wherein the first antenna resonating element comprises a portion of a peripheral conductive housing structure.

5. The electronic device antenna structures defined in claim 4 wherein the portion of the peripheral conductive housing structure is configured to form a dual arm inverted-F antenna resonating element.

6. The electronic device antenna structures defined in claim 5 wherein the second antenna resonating element comprises a monopole antenna resonating element.

7. The electronic device antenna structures defined in claim 6 further comprising an adjustable capacitor that is configured to tune the second antenna.

8. An electronic device, comprising:

antenna structures having first, second, and third antenna ports, wherein the antenna structures include an antenna ground, an inverted-F antenna resonating element that forms an inverted-F antenna with the antenna ground, and a monopole antenna resonating element that forms a monopole antenna with the antenna ground, the first and second antenna ports are coupled to different locations on the inverted-F antenna resonating element, and the third antenna port is coupled to the monopole antenna resonating element;

a duplexer;

a first wireless transceiver that transmits radio-frequency signals to the third antenna port through the duplexer; and a second wireless transceiver that transmits radio-frequency signals to the third antenna port through the duplexer and to the first antenna port.

9. The electronic device defined in claim 8 wherein the second wireless transceiver has a first transceiver port coupled to the duplexer and has a second transceiver port coupled to the first antenna port.

10. The electronic device defined in claim 9 wherein the second wireless transceiver is configured to handle cellular telephone communications frequencies in a communications band from 700 MHz to 960 MHz over the second transceiver port and is configured to handle Long Term Evolution band 38 and 40 communications over the first transceiver port.

11. The electronic device defined in claim 10 wherein the first wireless transceiver comprises a wireless local area network transceiver configured to handle 2.4 GHz and 5 GHz wireless local area network communications bands over the third antenna port.

12. The electronic device defined in claim 11 further comprising:

a first adjustable circuit interposed between the duplexer and the monopole antenna resonating element that is configured to tune the monopole antenna; and a second adjustable circuit interposed between the second transceiver port and the first antenna port that is configured to tune the inverted-F antenna.

13. The electronic device defined in claim 12 wherein the first adjustable circuit comprises a first adjustable capacitor and wherein the second adjustable circuit comprises a second adjustable capacitor.

14. The electronic device defined in claim 13 further comprising a satellite navigation system receiver coupled to the second antenna port.

15. Apparatus, comprising:

radio-frequency transceiver circuitry configured to handle wireless local area network signals, satellite navigation system signals, and cellular telephone signals;

an inverted-F antenna;

a first adjustable capacitor coupled between the radio-frequency transceiver circuitry and the inverted-F antenna, wherein the first adjustable capacitor is configured to tune the inverted-F antenna to handle at least some of the cellular telephone signals;

a monopole antenna that transmits the wireless local area network signals; and a second adjustable capacitor coupled between the radio-frequency transceiver circuitry and the monopole antenna, wherein the second adjustable capacitor is configured to tune the monopole antenna to handle at least some of the cellular telephone signals.

16. The apparatus defined in claim 15 wherein the radio-frequency transceiver circuitry comprises a first transceiver and a second transceiver, the apparatus further comprising a duplexer coupled to the second adjustable capacitor, the first transceiver, and the second transceiver.

17. The apparatus defined in claim 16 wherein the inverted-F antenna includes a segment of a peripheral conductive electronic device housing structure.

18. The apparatus defined in claim 17 further comprising:

a first signal line with which the first adjustable capacitor is coupled to the segment at a first location; and a second signal line that is coupled to the segment at a second location, wherein the satellite navigation system signals are conveyed to the radio-frequency transceiver circuitry using the second signal line.

19. The apparatus defined in claim 18 further comprising a conductive structure that serves as antenna ground for the inverted-F antenna and the monopole antenna.

20. The electronic device defined in claim 2, wherein the second antenna resonating element comprises a monopole resonating element that forms a monopole antenna with the antenna ground, and the monopole resonating element is formed in a gap between the inverted-F antenna resonating element and the antenna ground.

21. The electronic device defined in claim 20, wherein the monopole resonating element has a first branch that covers a first wireless local area network frequency band and a second branch that covers a second wireless local area network frequency band, and the inverted-F antenna resonating element is coupled to the antenna ground by a short circuit path that spans the gap and that overlaps a portion of the monopole resonating element in the gap.

22. The electronic device defined in claim 8, wherein the first wireless transceiver receives radio-frequency signals from the third antenna port through the duplexer and the second wireless transceiver receives radio-frequency signals from the third antenna port through the duplexer and from the first antenna port.

* * * * *